US007177440B2

(12) United States Patent
Turnmire et al.

(10) Patent No.: US 7,177,440 B2
(45) Date of Patent: Feb. 13, 2007

(54) ELECTROMAGNETIC TRANSDUCER WITH ASYMMETRIC DIAPHRAGM

(75) Inventors: Patrick M. Turnmire, Tempe, AZ (US); Enrique M. Stiles, Imperial Beach, CA (US); Richard C. Calderwood, Portland, OR (US)

(73) Assignee: Step Technologies Inc., Minneapolis, MN (US)

( * ) Notice: Subject to any disclaimer, the term of this patent is extended or adjusted under 35 U.S.C. 154(b) by 310 days.

(21) Appl. No.: 10/334,752

(22) Filed: Dec. 31, 2002

(65) Prior Publication Data

US 2004/0125980 A1 Jul. 1, 2004

(51) Int. Cl.
*H04R 25/00* (2006.01)

(52) U.S. Cl. ..... 381/412; 381/404; 381/423

(58) Field of Classification Search ..... 381/398, 381/404, 411–412, 423–424, 426, 430–433; 181/164, 171, 172–173
See application file for complete search history.

(56) References Cited

U.S. PATENT DOCUMENTS 3,111,189 A * 11/1963 Scholl ..... 181/164
3,180,945 A * 4/1965 Suzuki ..... 381/432
3,334,195 A * 8/1967 Ashworth ..... 381/411
3,464,514 A * 9/1969 Kazukiyo et al. ..... 381/432
3,483,946 A * 12/1969 Sotome ..... 181/171
3,570,626 A * 3/1971 Mochida et al. ..... 181/164
4,821,330 A * 4/1989 Pfleiderer ..... 381/424
6,442,282 B2 * 8/2002 Azima et al. ..... 381/423

* cited by examiner

*Primary Examiner*—Suhan Ni
(74) *Attorney, Agent, or Firm*—Richard C. Calderwood

(57) ABSTRACT

An electromagnetic transducer such as an audio speaker which includes an asymmetric diaphragm to deliver smooth frequency response with reduced distortion by reduction of common modes in the diaphragm. Other benefits such as asymmetric directivity patterns can be realized. The asymmetric cone has a perimeter OD at which a surround may be coupled, and an ID at which a bobbin or spacer may be coupled. The center of the ID is not coincident with the center of the OD. The transducer further includes a stabilization mechanism for reducing rocking of the diaphragm assembly. The stabilization mechanism may include mass balancing of the diaphragm and/or adjustments to the location or symmetry of the suspension components.

17 Claims, 12 Drawing Sheets

Fig. 1 - prior art

ELECTROMAGNETIC TRANSDUCER WITH ASYMMETRIC DIAPHRAGM

BACKGROUND OF THE INVENTION

1. Technical Field of the Invention

This invention relates generally to electromagnetic transducers such as audio speakers, and more specifically to an electromagnetic transducer having a diaphragm or cone which is asymmetric, meaning that the ID of the cone is not at the geometric center of the OD of the cone. The ID or inner diameter refers to the location, typically but not always a hole, where the bobbin attaches to the diaphragm. The OD or outer diameter refers to the outer perimeter where typically the surround attaches to the diaphragm.

2. Background Art

FIG. 1 illustrates a conventional audio speaker 10 such as is known in the prior art. The speaker includes a motor assembly 12 coupled to a diaphragm assembly 14 by a frame 16. The motor assembly includes a magnetic air gap 18 over which magnetic flux flows. The diaphragm assembly includes an electrically conductive voice coil 20 which is rigidly attached to a bobbin or voice coil former 22. The voice coil is suspended within the magnetic air gap to provide mechanical force to an acoustical radiating member 24, often termed a diaphragm or cone, which is coupled to the bobbin. When an alternating electric current is passed through the voice coil, the voice coil moves axially in the air gap, causing the diaphragm to generate sound waves. The diaphragm assembly further includes two suspension components which serve to keep the bobbin and diaphragm centered and aligned with respect to the motor assembly, while allowing axial movement. A damper or spider 26 is coupled to the bobbin and the frame, and a surround 28 is coupled to the diaphragm and the frame. A dust cap 30 seals the assembly and protects against infiltration of dust particles and other stray materials which might contaminate the magnetic air gap and thereby interfere with the operation or quality of the speaker.

The motor assembly has an axis $A_m$ typically understood to be at the axial center of the magnetic air gap in which the voice coil rides. The diaphragm has an OD or outer perimeter which has a geometric center or axis $A_{od}$. It is the same distance OD1 from the axis $A_{od}$ to a first point on the OD and to a second point on the OD, which two points are radially opposite each other. The diaphragm may be axisymmetric, in the case of e.g. a round 6" speaker. Alternatively, the diaphragm may be bilaterally symmetric, in the case of e.g. an elliptical 6×9 speaker. Other diaphragm OD shapes are known in the art, as well. The diaphragm also has an ID or inner perimeter which has a geometric center or axis $A_{id}$. It is the same distance ID1 from the axis $A_{id}$ to a first point on the ID and to a second point on the ID, which two points are radially opposite each other. In nearly all cases, speakers use a cylindrical bobbin and a circular ID, but a few exceptions are known. The spider has a center or axis of suspension $A_{sp}$, and the surround has an center or axis of suspension $A_{su}$.

As shown in FIG. 1, virtually all known speakers are constructed such that the motor axis $A_m$, the axis $A_{od}$ of the OD, the axis $A_{id}$ of the ID, the axis of suspension $A_{sp}$ of the spider, and the axis of suspension $A_{su}$ of the surround, are all coaxial with one another.

Ordinarily, in most engineering applications it is desirable to achieve symmetry. However, in audio applications, symmetry has some disadvantages. For example, a symmetric cone exhibits the same breakup modes in all radial segments, as each radial segment has the same shape, size, mass, etc.

as the others. As another example, a symmetric speaker exhibits equal diffraction characteristics and cone/edge junction modes at all radial segments.

FIGS. 2 and 3 are copied from U.S. Pat. No. 5,022,488 "Transducer Enclosure" issued Jun. 11, 1991 to William House and assigned to Harman International. The House patent teaches a speaker 31 having an asymmetric diaphragm 33. That inventor was addressing a completely unrelated problem, that of fitting two speakers 35, 37 into a single cabinet 39 with separate pressure venting for each. He appears to have moved the woofer's motor structure 41 away from the center of the woofer's diaphragm 33 merely for the purpose of providing physical space for the tweeter 37 to fit in front of a portion of the woofer's diaphragm, and not to have recognized any other benefits from the asymmetry. Indeed, the patent states that "it is not necessary for diaphragm [of the woofer] to be asymmetric, nor for diaphragm [of the tweeter] to be symmetric, nor for either transducer to be a diaphragm type at all." (col. 3 lines 57–60, reference numbers omitted, bracketed text added). It is noteworthy that the woofer diaphragm is an inverted cone, rather than a conventionally oriented cone with its bell facing outward. This was clearly done to make still more room for the tweeter within the design constraint of gaining "the benefits of shallow loudspeaker mounting" (col. 1 line 11).

BRIEF DESCRIPTION OF THE DRAWINGS

The invention will be understood more fully from the detailed description given below and from the accompanying drawings of embodiments of the invention which, however, should not be taken to limit the invention to the specific embodiments described, but are for explanation and understanding only.

DETAILED DESCRIPTION

The invention may be utilized in a variety of magnetic transducer applications, including but not limited to audio speakers, microphones, and the like. For the sake of convenience, the invention will be described with reference to audio speaker embodiments, but this should be considered illustrative and not limiting. For ease of illustration only, the invention will be illustrated with reference to an external magnet geometry speaker, but is not so limited.

Figure 1:
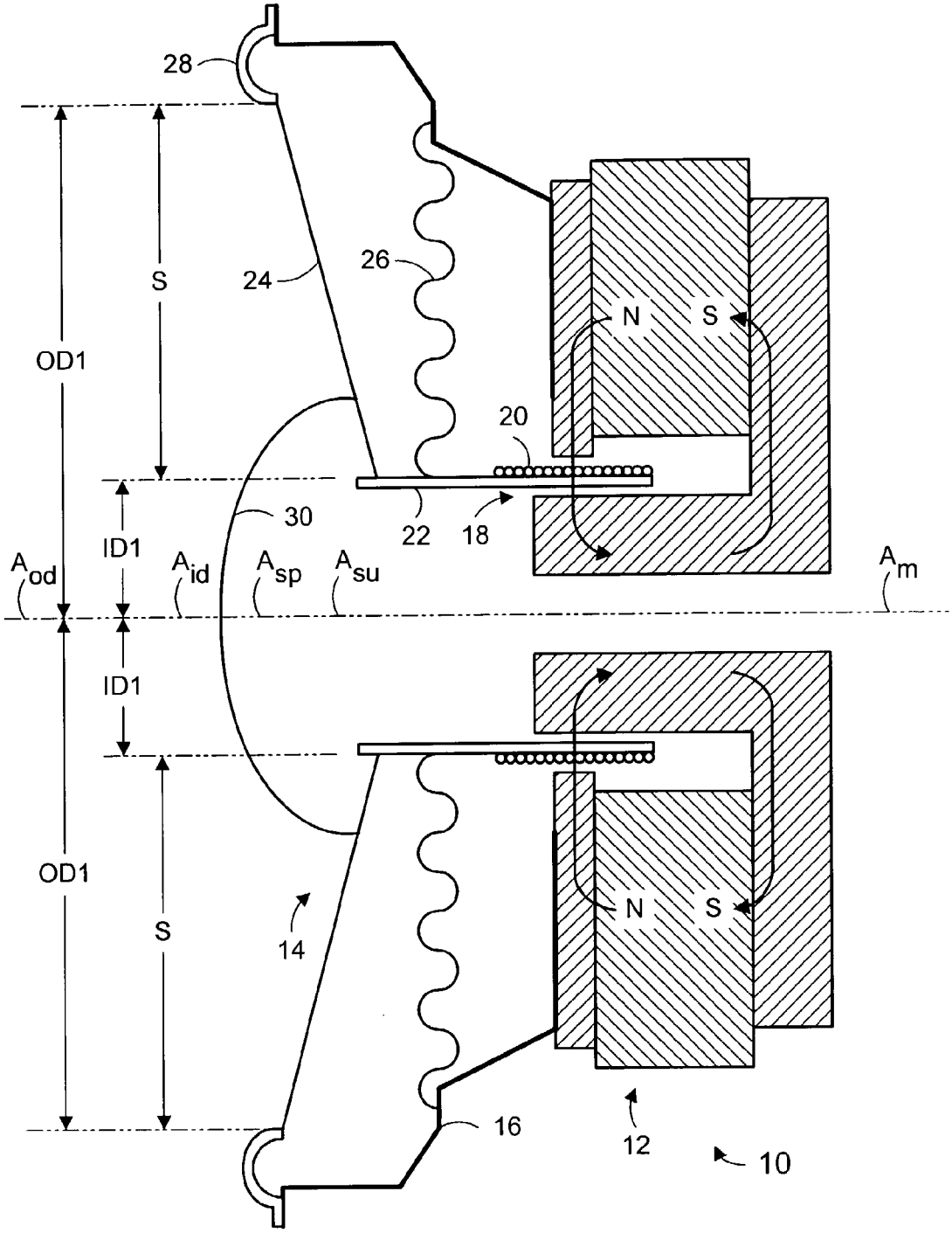
FIG. 1 shows, in cross-section, a conventional speaker geometry according to the prior art.
Figure 2:
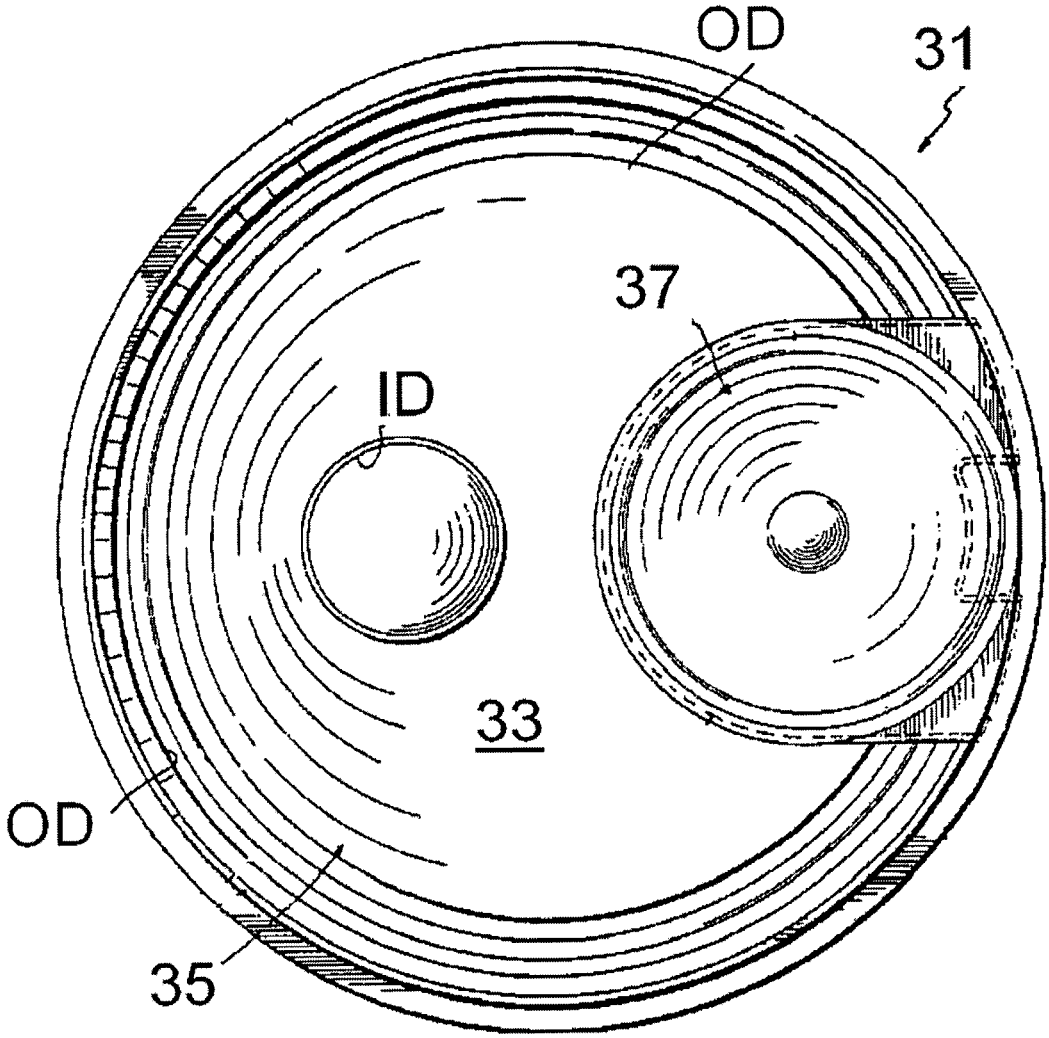
Fig. 2 prior art
FIGS. 2 and 3 show a prior art two-speaker arrangement according to U.S. Pat. No. 5,022,488, in which one of the speakers has an asymmetric diaphragm.
Figure 3:
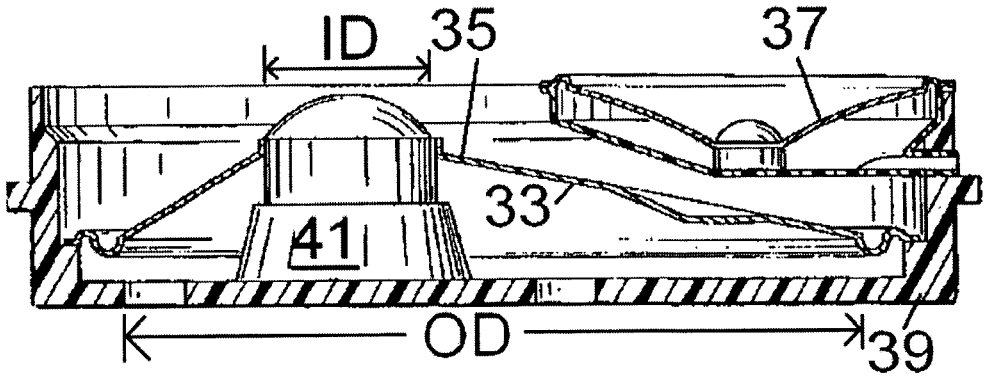
Fig. 3 prior art
Figure 4:
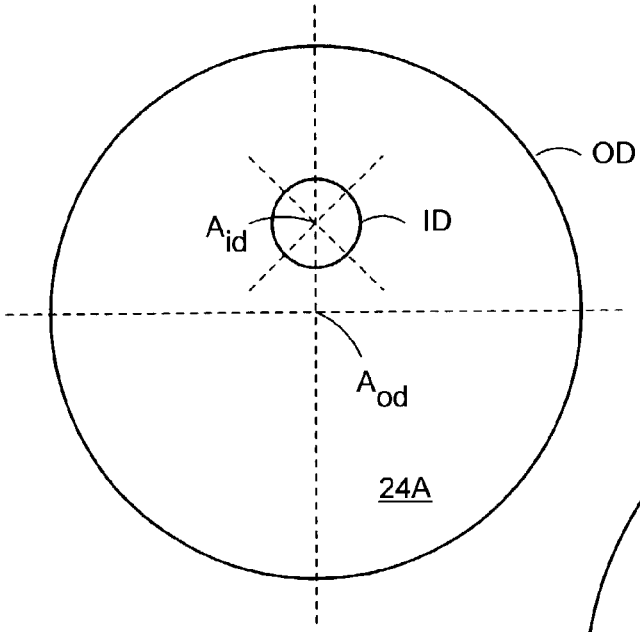
FIG. 4 shows a front view of a circular OD diaphragm having an off-center ID.

FIG. 4 illustrates a front view of an axisymmetric-OD (round) diaphragm 24A in which the ID is not concentric with the OD. The axis $A_{id}$ is not coaxial with the axis $A_{od}$.

Figure 5:
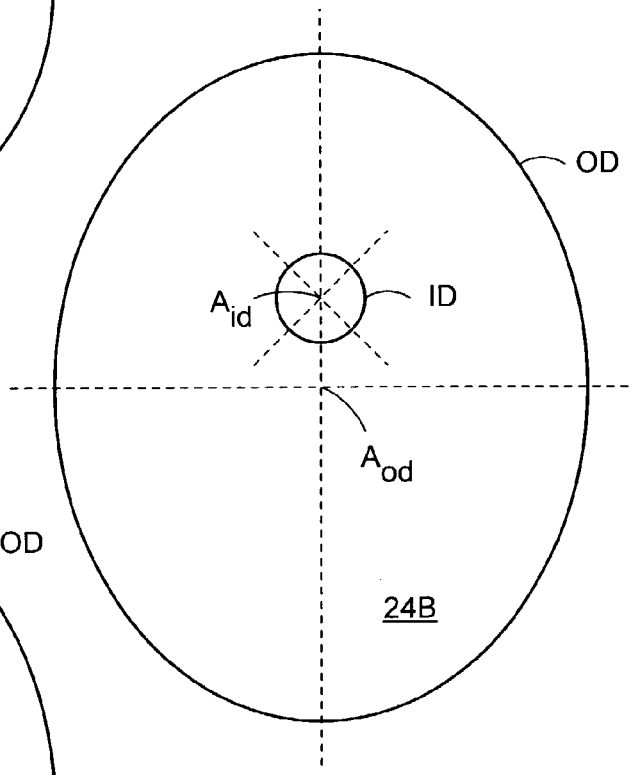
FIG. 5 shows a front view of an elliptical OD diaphragm having an ID which is located on one line of symmetry but off the other line of symmetry of the ellipse.

FIG. 5 illustrates a front view of an elliptical diaphragm 24B in which the ID center is not at the center of the OD. The elliptical diaphragm is bilaterally symmetric about a vertical line and a horizontal line. The ID is located on one of these lines but not on the other. The axis $A_{id}$ is not coaxial with the axis $A_{od}$.

Figure 6:
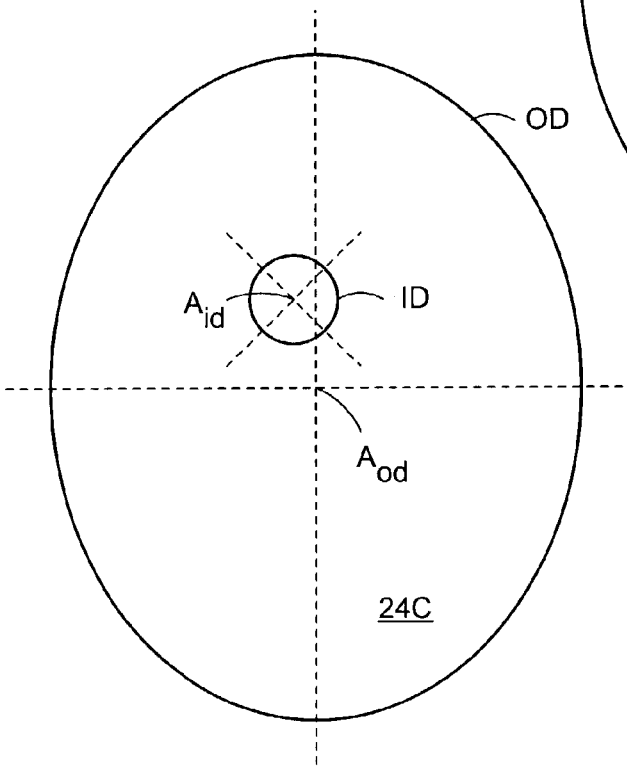
FIG. 6 shows a front view of an elliptical OD diaphragm having an ID which is located off both lines of symmetry of the ellipse.

FIG. 6 illustrates a front view of an elliptical diaphragm 24C in which the ID center is not at the center of the OD. The elliptical diaphragm is bilaterally symmetric about a vertical line and a horizontal line. The ID center is not located on either of these lines. The figure further suggests that it is not necessarily the case that an asymmetric cone have its ID completely on or off a particular bilateral symmetry line; in other words, zero, one, or both of those lines may pass through the ID, so long as they are not both coincident with the center of the ID. The axis $A_{id}$ is not coaxial with the axis $A_{od}$.

The reader will readily appreciate that, while round and elliptical asymmetric diaphragms have been shown, the invention is not thus limited. The reader will further appreciate that the asymmetric diaphragm may be practiced with conventional, concave cones, or with inverted cones, or with flat diaphragms, or with other diaphragm configurations.

Figure 7:
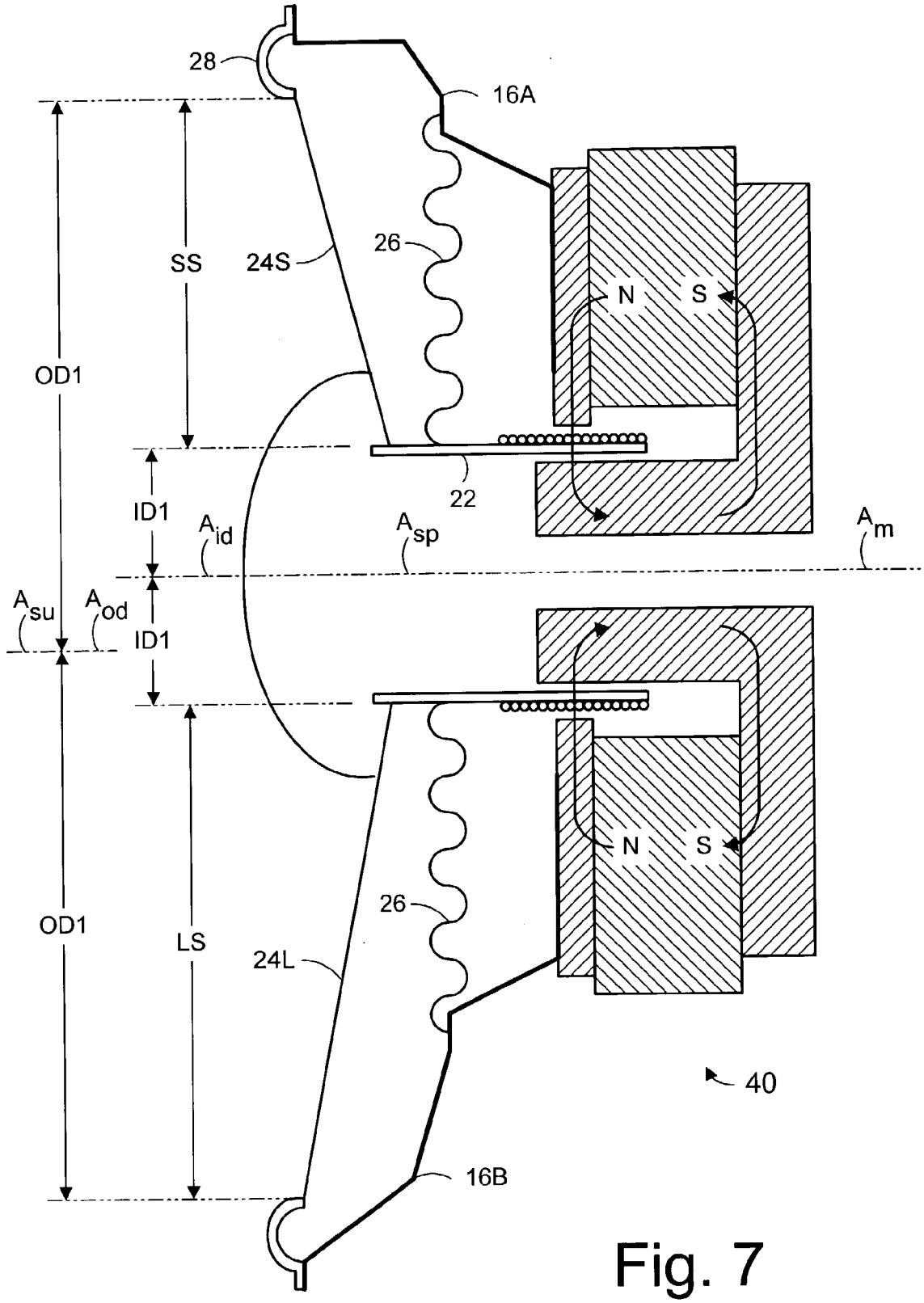
FIG. 7 shows, in cross-section, a speaker having an asymmetric diaphragm and an on-motor-axis symmetric spider.

FIG. 7 illustrates one embodiment of a speaker 40 in which the axis $A_{od}$ of the OD of the diaphragm is not coaxial with the axis $A_{id}$ of the ID of the diaphragm. In this example, the $A_{id}$ is coaxial with the axis $A_m$ of the motor assembly. With the ID off-center from the OD, the diaphragm 24 includes a short side 24S and a long side 24L on opposite sides of the ID. The frame includes a first portion 16A adapted to hold the short side 24S and a second portion 16B adapted to hold the long side 24L. A symmetric spider 26 is coupled to and centered about the bobbin 22, which is coaxial with the axis $A_m$ of the motor assembly.

The axis of suspension $A_{su}$ of the symmetric surround 28 is generally coaxial with the $A_{od}$, but the axis of suspension $A_{sp}$ of the symmetric spider 26 is generally coaxial with the $A_{id}$, and the $A_{od}$ and $A_{id}$ are not coaxial. This may tend to cause rocking of the diaphragm assembly during operation of the speaker.

The short side 24S and long side 24L of the diaphragm have respected projected chords SS and LS.

The high frequency dispersion pattern of the speaker will be asymmetrically controlled by the resultant angle, from the primary motor axis, of the long side with respect to that of the short side. By employing an asymmetric diaphragm, the speaker designer can control the dispersion by modifying the ratio of the long side to short side, which in turn affects the respective angles of the diaphragm at those locations.

Figure 8:
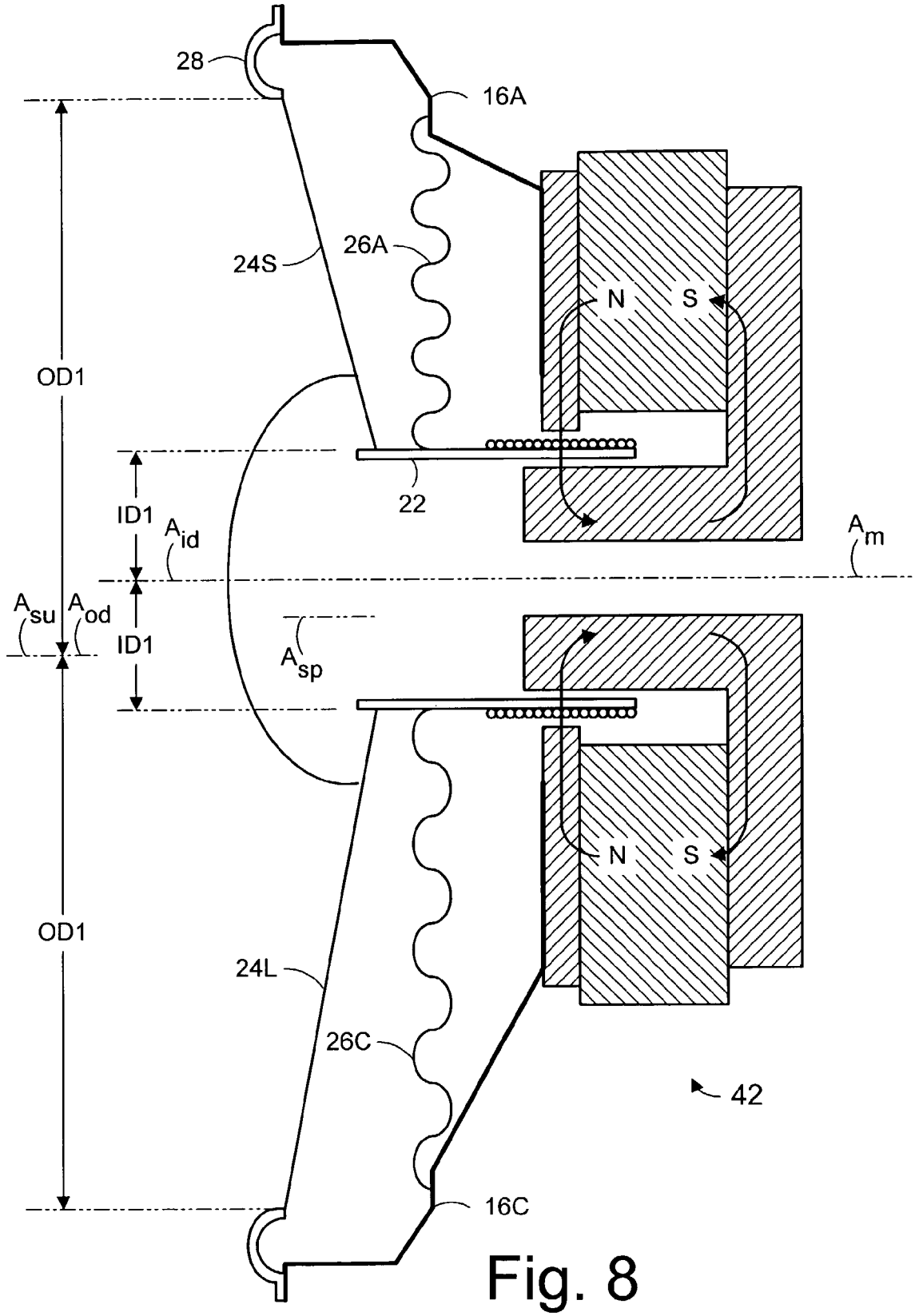
FIG. 8 shows, in cross-section, a speaker having an asymmetric diaphragm and an asymmetric spider.

FIG. 8 illustrates a speaker 42, demonstrating one possibility for making the $A_{sp}$ more coaxial with the $A_{su}$. The spider 26 is formed so as to not be axisymmetric about the bobbin 22. The asymmetric spider includes a short side 26A and a long side 26C. The frame includes a first portion 16A adapted to hold the short side 24S of the diaphragm and the short side 26A of the spider, and a second portion 16C adapted to hold the long side 24L of the diaphragm and the long side 26C of the spider. Typically, the frame and spider may each be constructed with a continuously varying shape to provide a smooth transition from its first portion to its second portion. The geometric center of the spider has been moved from the axis $A_m$ of the motor assembly toward the geometric center of the diaphragm $A_{od}$, but at the cost of having larger, more compliant rolls of material in the longer side of the spider.

This embodiment has the disadvantage that the softer portion of the spider suspension (with larger, more compliant rolls) is supporting the heavier portion of the diaphragm on the diaphragm's longer side. The long side of the diaphragm may have a greater moment of rotational inertia about the $A_{id}$ than does the short side, which may cause rocking in response to acceleration of the diaphragm assembly. This may be exacerbated by the spider being softer on the long side of the diaphragm. In other words, while the $A_{sp}$ has been moved off of the $A_m$, it has moved toward the $A_{su}$ rather than away from it, and both suspension components have their axis of suspension on the same side of $A_m$.

Figure 9:
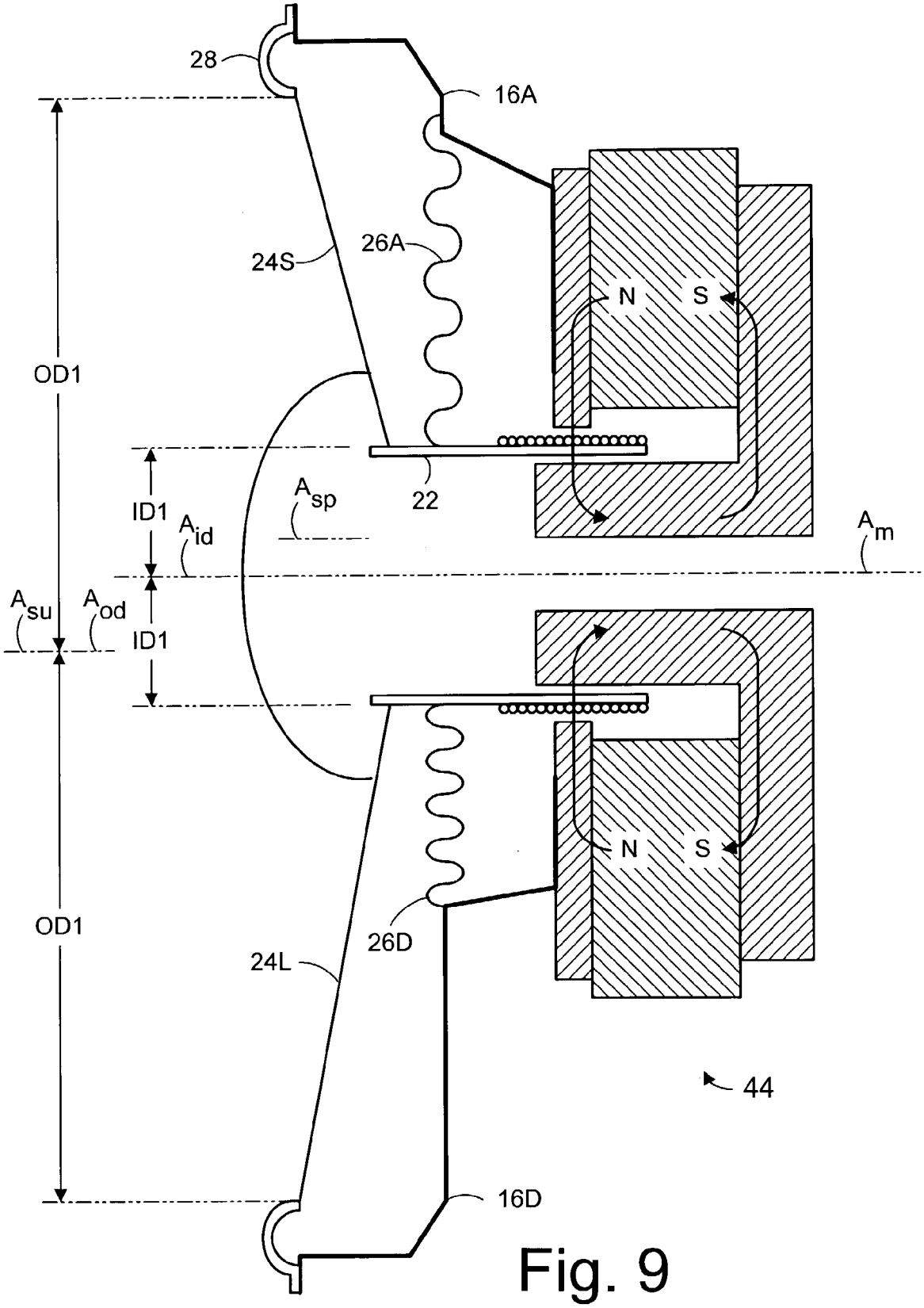
FIG. 9 shows, in cross-section, a speaker having an asymmetric diaphragm and an asymmetric spider.

FIG. 9 illustrates one embodiment of a speaker 44 in which the axes of suspension have been adjusted to reduce rocking. The frame includes a first portion 16A adapted to hold the short side 24S of the diaphragm, and a second portion 16D adapted to hold the long side 24L of the diaphragm. A first portion 26A of the spider is adapted to secure the bobbin to the first portion 16A of the frame, and a second portion 26D of the spider is adapted to secure the bobbin to the second portion 16D of the frame. The $A_{sp}$ of the asymmetric spider has been moved from the $A_m$ of the motor assembly farther away from the $A_{od}$ of the diaphragm, with the result of having smaller, and therefore stiffer, rolls of material in the shorter side of the spider which is suspending the bobbin on the long side of the diaphragm. Thus, the stiffer portion of the spider is suspending the longer, heavier side of the diaphragm, in order to balance the diaphragm displacement of both sides of the speaker, at resonance, which will in turn minimize the tendency for rocking to occur. In addition, the $A_{sp}$ is moved to the opposite side of $A_m$ from the $A_{su}$ and thus the average of $A_{sp}$ and $A_{su}$ more closely coincides with $A_m$ with the result that, if rocking occurs, the rotational center of the rocking will more closely coincide with the center of the voice coil, minimizing the chances of the voice coil striking or rubbing the motor structure.

In either of these embodiments, one could reduce the rocking tendency by altering the shape or compliance of the surround instead the spider. Or, one could alter both the spider and the surround. The skilled designer will need to take into account the relative stiffnesses of the surround and the spider, and the relative mass and balance of the diaphragm, as well as the relative mass and balance of the rest of the moving components including the spider and the surround, in determining where to place the axes of suspension of the surround and spider in order to achieve a balanced, non-rocking speaker.

Figure 10:
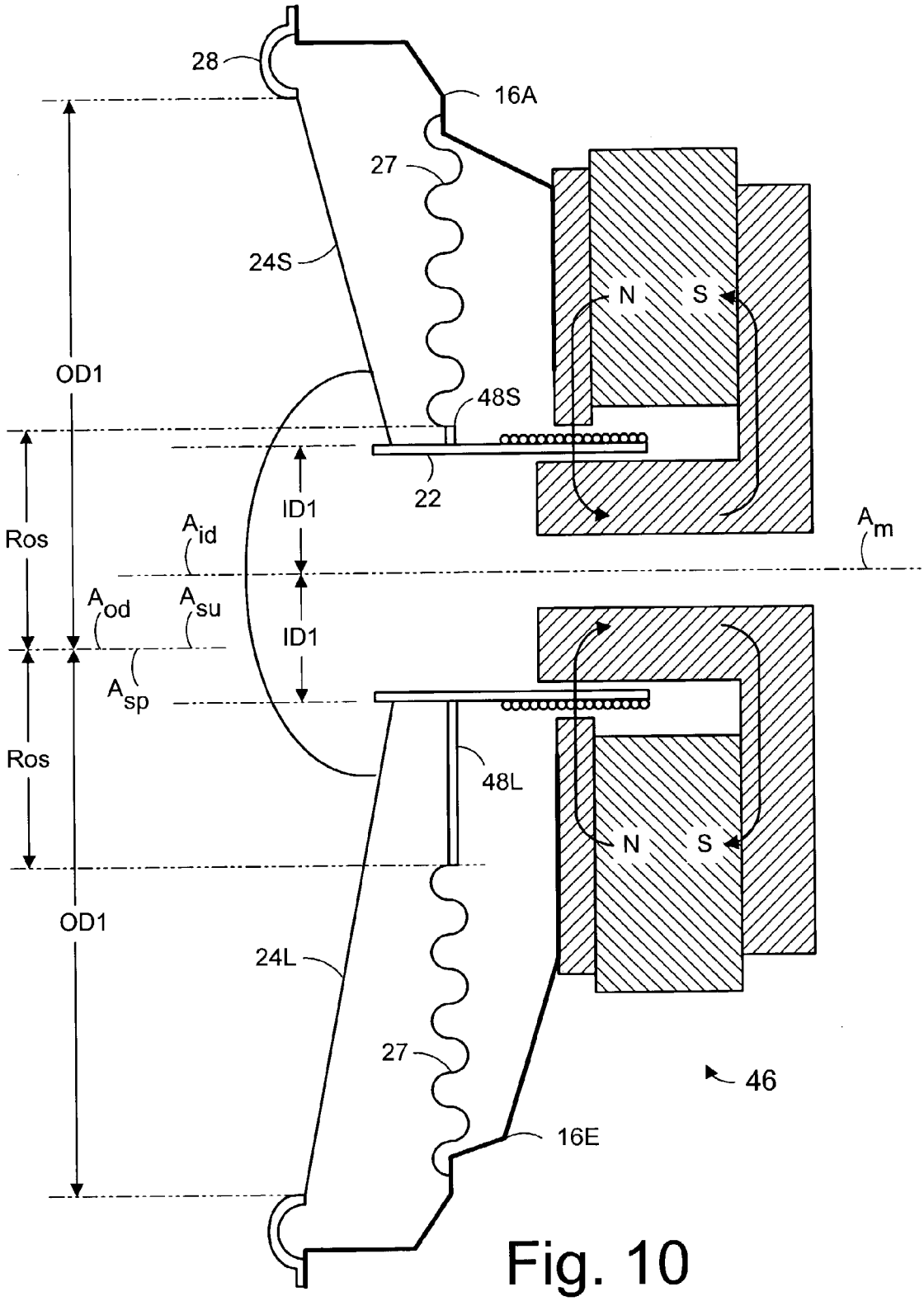
FIG. 10 shows, in cross-section, a speaker having an asymmetric diaphragm and an off-motor-axis symmetric spider.

FIG. 10 illustrates another embodiment of a speaker 46 which uses a symmetric spider 27, but which moves the axis $A_{sp}$ of the spider's suspension to be substantially coaxial with the axis $A_{su}$ of the surround's suspension. The frame includes a first portion 16A adapted to hold the short side 24S of the diaphragm, and a second portion 16E adapted to hold the long side 24L of the diaphragm. A rigid, eccentric spacer 48 is coupled between the bobbin and the spider. The spacer includes a short side 48S located with the short side of the diaphragm, and a long side 48L located with the long side of the diaphragm. The geometric center of the spacer, as measured by distance $R_{os}$ from points along its outer perimeter where it mates with the spider, is substantially coaxial with the $A_{od}$ of the diaphragm and, thus, coaxial with the $A_{su}$ of the surround. With the spacer rigidly coupled to the bobbin, the bobbin is effectively suspended by the spider about the axis $A_{od}$ of the diaphragm, although the voice coils and bobbin themselves remain centered about the axis $A_m$ of the motor assembly. The $A_{sp}$ and $A_{su}$ are substantially coaxial with $A_{od}$, to reduce rocking.

Figure 11:
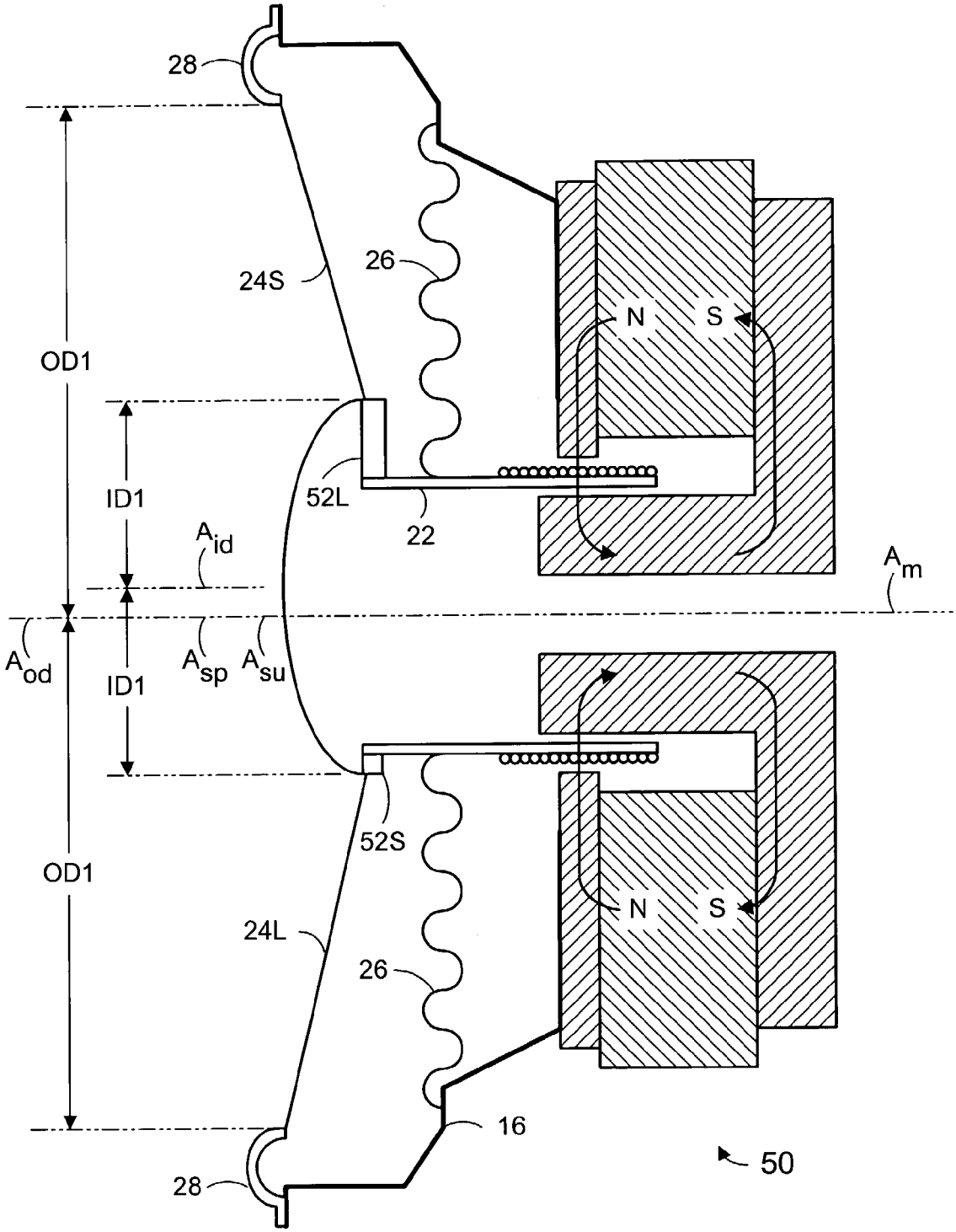
FIG. 11 shows, in cross-section, a speaker having an asymmetric diaphragm and an on-motor-axis symmetric spider, frame, and surround.

FIG. 11 illustrates another embodiment of a speaker 50 which uses a similar arrangement, except that an eccentric diaphragm spacer 52 is coupled between the bobbin and the diaphragm, rather than between the bobbin and the spider. This speaker has the further advantage that, except for its asymmetric cone and the eccentric spacer, the rest of its components can be conventional, symmetric parts, including the frame 16, spider 26, and surround 28. With a symmetric frame, the $A_{od}$ is coaxial with the $A_m$, the $A_{su}$ is coaxial with the $A_{sp}$, and, in fact, all four of those may be coaxial, with only the $A_{id}$ being at a different location, which makes balancing the diaphragm assembly relatively simple.

Figure 12:
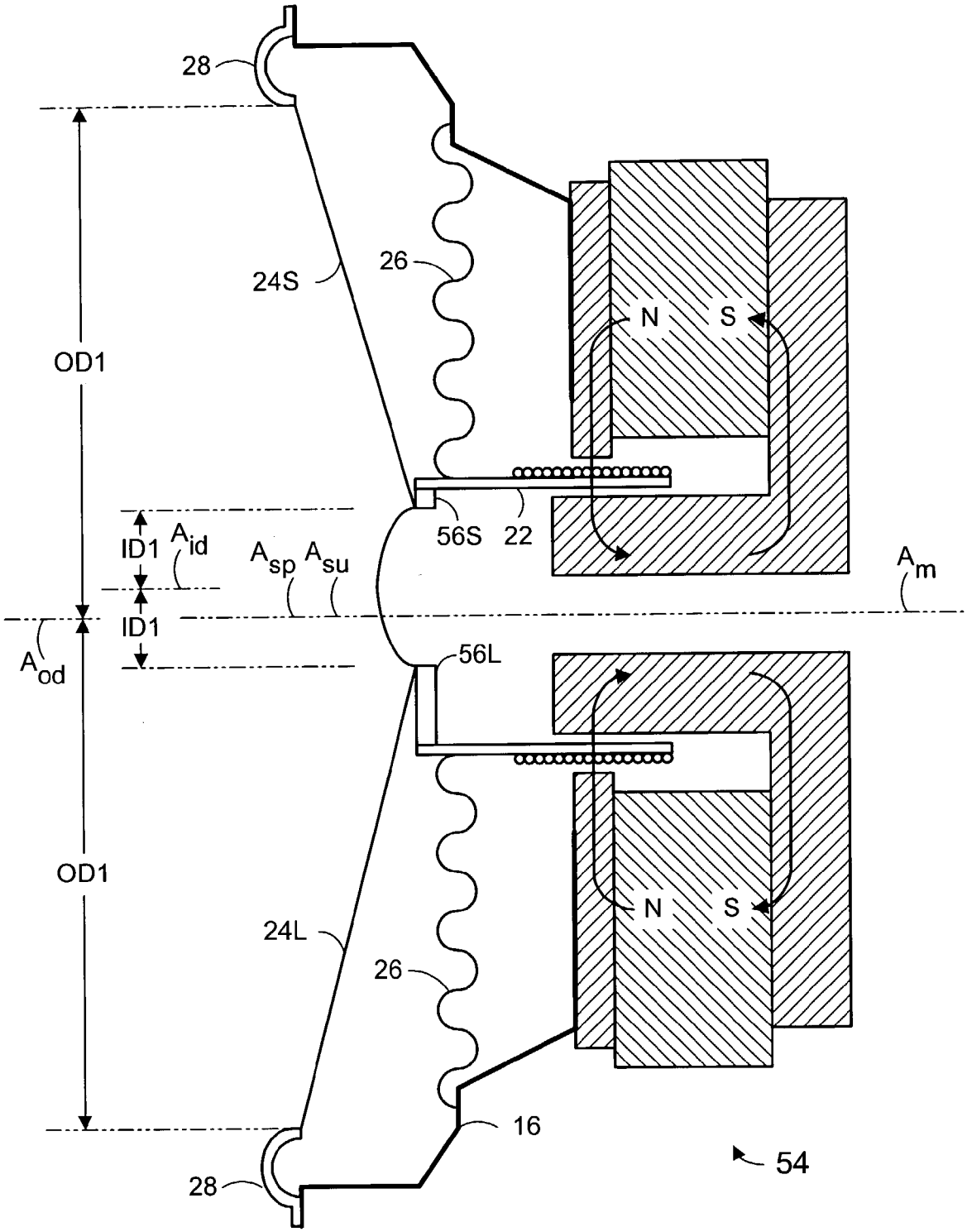
FIG. 12 shows, in cross-section, a speaker having an asymmetric diaphragm and an on-motor-axis symmetric spider, frame, and surround.

FIG. 12 illustrates another embodiment of a speaker 54, in which the eccentric diaphragm spacer 56 has an OD which is coupled to the bobbin ID, meaning that the spacer is disposed within the bobbin with a short side 56S of the spacer adjacent the short side 24S of the diaphragm, and a long side 56L of the spacer adjacent the long side 24L of the diaphragm. The off-center cone ID is coupled to the ID of the eccentric spacer.

Figure 13:
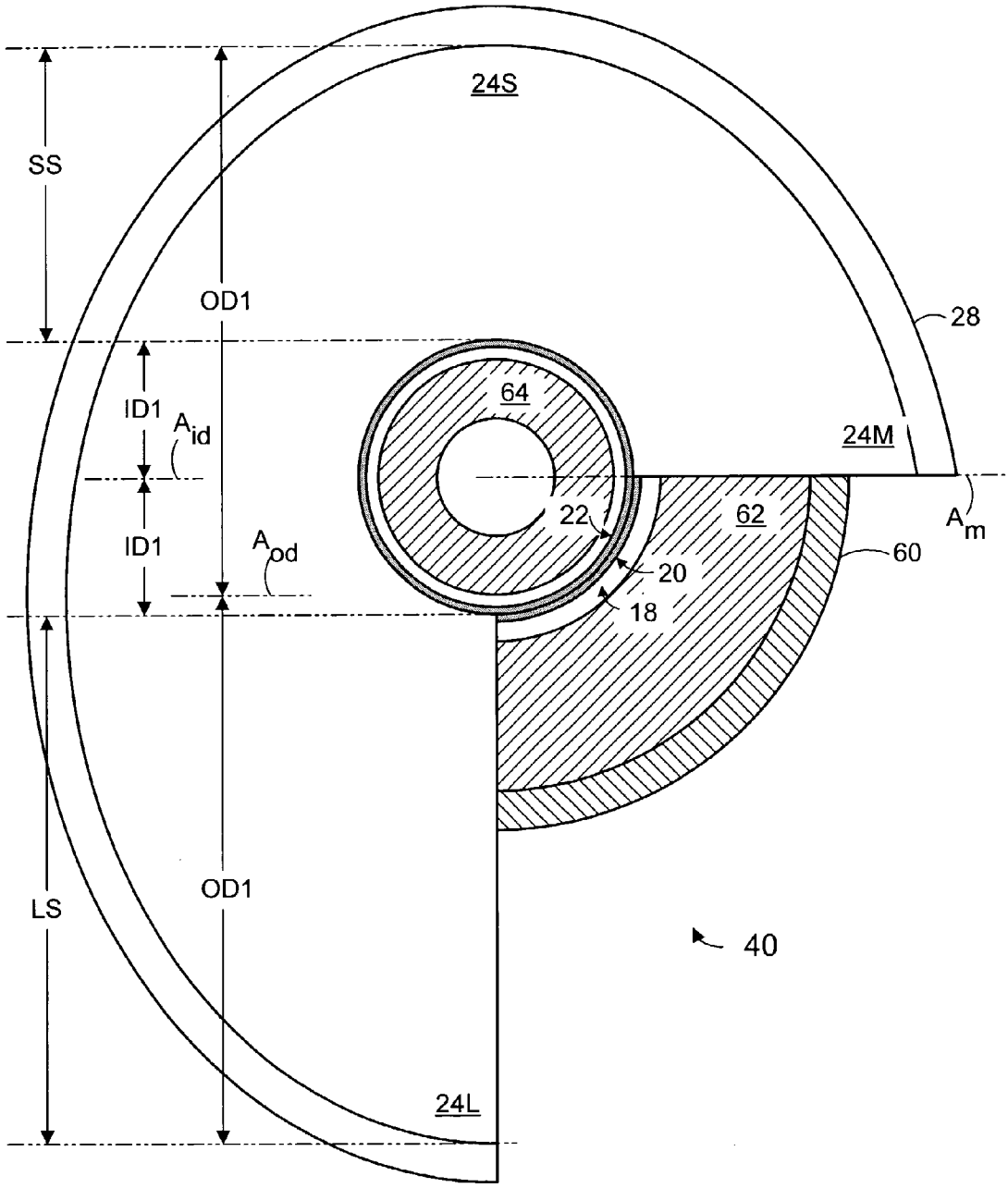
FIG. 13 shows, in partial cutaway top view, a speaker having an asymmetric diaphragm.

FIG. 13 illustrates the speaker 40 of FIG. 7, in partial cutaway top view with some of the components removed for better visibility of underlying components. The speaker includes a motor assembly having a magnet 60 and a top plate 62 surrounding a pole piece 64. The diaphragm assembly includes a voice coil 20 coupled to a bobbin 22 within the magnetic air gap 18 between the pole piece and the top plate. An asymmetric diaphragm 24 is coupled to the bobbin and includes a short side 24S, a long side 24L opposite the short side, and an intermediate portion 24M providing a size transition between the short side and the long side. The $A_{id}$ is not coincident with the $A_{od}$.

Figure 14:
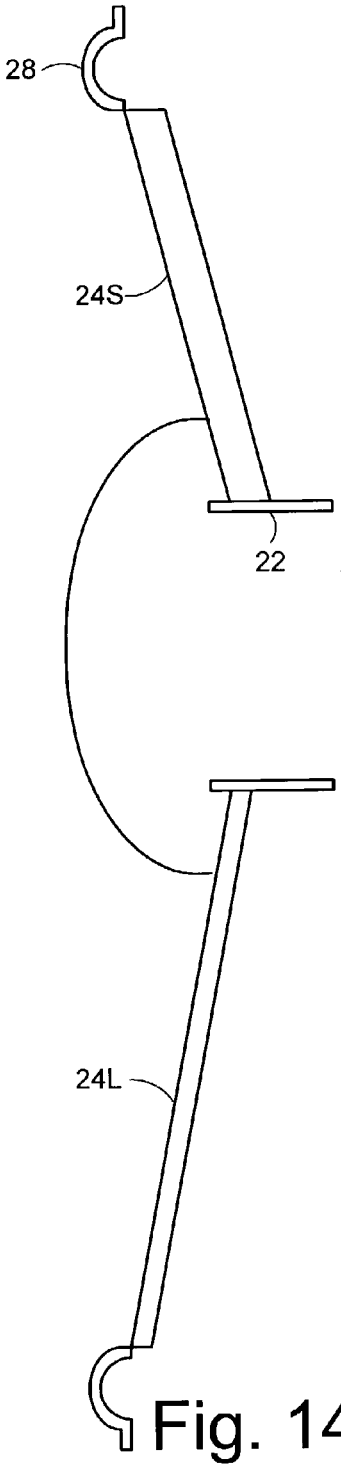
FIG. 14 shows, in cross-section, a portion of an asymmetric diaphragm assembly with mass balancing of the diaphragm by making the shorter side thicker than the longer side.

FIG. 14 illustrates a partial diaphragm assembly in which the diaphragm has been balanced by adding mass to the short side 24S by making it thicker, and/or by removing mass from the long side 24S by making it thinner. Typically, but not necessarily, the thickness transition may be continuous around the diaphragm thickness from the thick side to the thin side.

Figure 15:
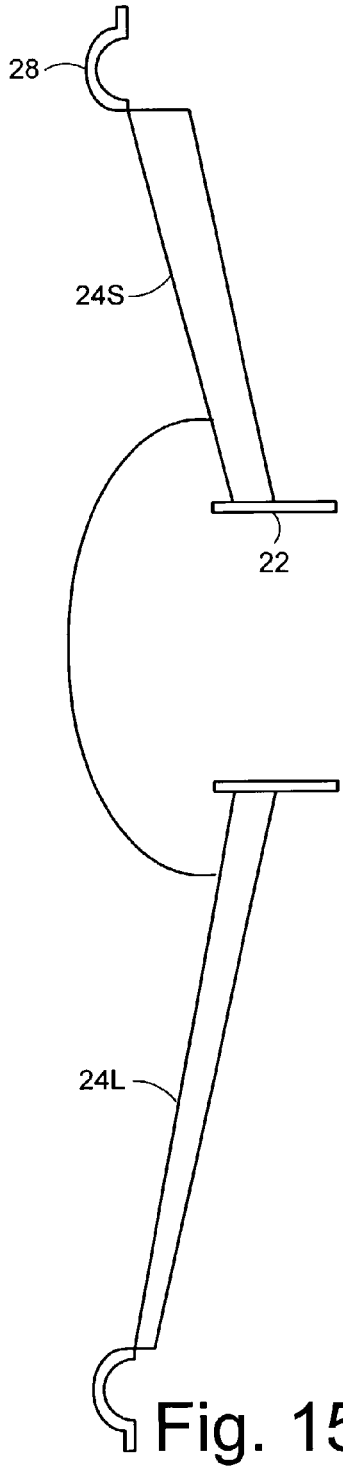
FIG. 15 shows, in cross-section, a portion of an asymmetric diaphragm assembly with mass balancing of the diaphragm by tapering the diaphragm thickness and weighting each side toward the outer edge of the short side.

FIG. 15 illustrates a partial diaphragm assembly in which the balancing has further been accomplished by tapering the diaphragm to bias one or both sides 24S, 24L of the diaphragm toward the outer edge of the short side 24S. The short side is thicker at its OD edge (at the surround 28) than it is at its ID edge (at the bobbin 22), and the long side is thicker at its ID edge than it is at its OD edge. Typically, but not necessarily, the taper transition may be continuous around the diaphragm from one side to the other.

Figure 16:
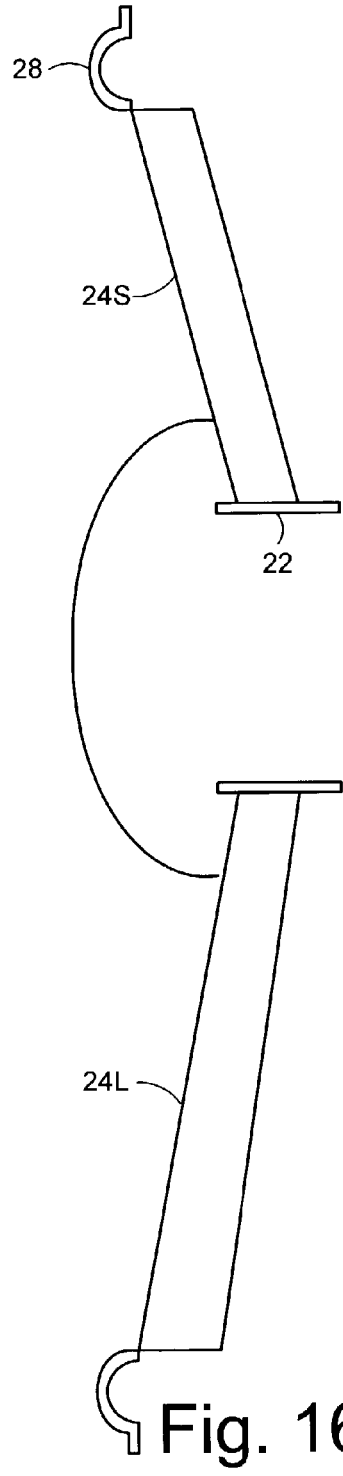
FIG. 16 shows, in cross-section, a portion of an asymmetric diaphragm assembly with mass balancing after differential foaming of the diaphragm material to increase the stiffness of the long side.

FIGS. 15 and 16 together also illustrate one particularly advantageous method of forming the diaphragm. The diaphragm is formed from a plastic such as polypropylene, or any other suitable material, in a mould having a taper as shown in FIG. 15. Then, at the correct time during the moulding and curing process, the mould halves for the top and bottom surfaces of the diaphragm are hinged partially open, with the hinge at or near the OD edge of the short side 24S of the diaphragm, such that the mould opens more at the OD edge of the long side 24L of the diaphragm than it does in the middle near the bobbin, and more in the middle than at the hinge. When the mould is hinged open, the material (typically in the presence of an activating agent) will foam to fill the newly enlarged space. Thus, the OD edge of the long side 24L will foam to a more increased thickness than will the other portions of the diaphragm. The mass in each locality will stay the same as before the differential foaming, but the density will change in relationship to the locality's distance and angle from the hinge. The longer side will be less dense than the shorter side. In general, the more the foaming increases the thickness, the stiffer that locality will be. By appropriately selecting the diaphragm material, shaping the mould halves, locating the hinge, and hinging the mould halves open to induce foaming, the designer can achieve a diaphragm having any desired stiffness, thickness, and mass profile. In particular, it may be desirable to create a diaphragm which demonstrates equal stiffness along each chord, in every angle, to minimize cone breakup modes and other undesirable effects which may distort the sound produced by the speaker, and at the same time, achieve mass balancing in order to reduce rocking modes.

Alternatively, rather than shifting the mass of the diaphragm material, balancing may be accomplished by simply affixing a weight to the diaphragm in a suitable location.

Figure 17:
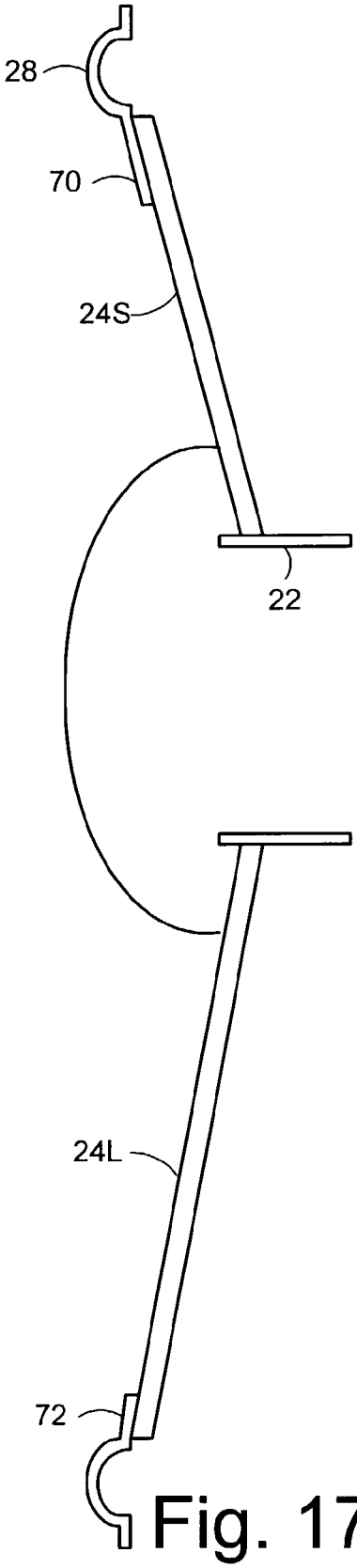
FIG. 17 shows, in cross-section, a portion of an asymmetric diaphragm assembly with mass balancing assisted by suitably making the inactive attachment portion of the surround longer, and thus heavier, at the short side of the diaphragm.

FIG. 17 illustrates a different balancing mechanism, in which the mass of the surround 28 is used to balance the diaphragm 24. On the short side, the portion 70 of the surround which is affixed to the diaphragm (and therefore is simply moving mass, and not an active part of the suspension) is cut or formed so as to be longer than that portion 72 which is affixed to the long side of the diaphragm.

Figure 18:
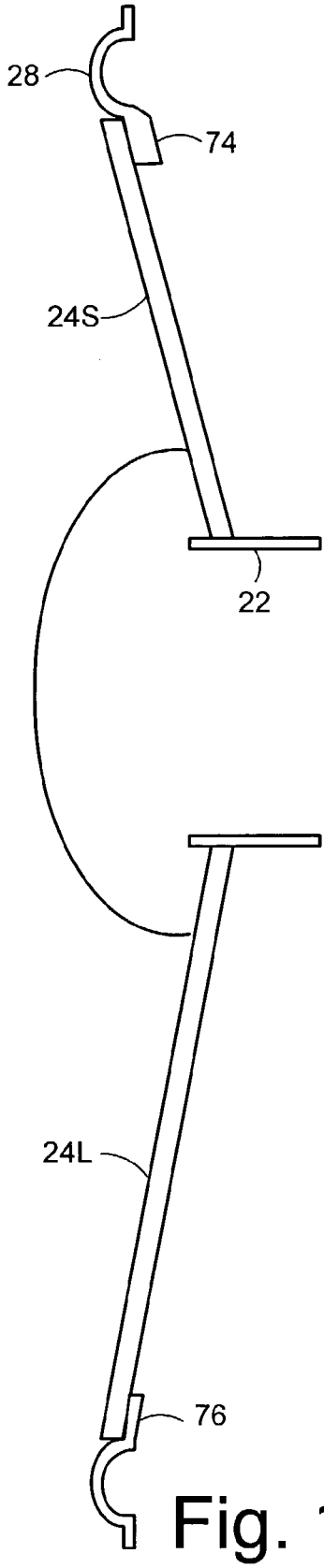
FIG. 18 shows, in cross-section, a portion of an asymmetric diaphragm assembly with mass balancing assisted by making the inactive attachment portion of the surround thicker, and thus heavier, at the short side of the diaphragm. For convenience, a rear-attach surround is used.

FIG. 18 illustrates a similar balancing mechanism, in which the portion 74 of a rear-attached surround which is affixed to the short side of the diaphragm is made thicker than the portion 76 which is affixed to the long side of the diaphragm.

With reference now to any of the figures describing the invention, in order to achieve desired acoustic results, the dimensional ratio between the short side and the long side may be adjusted by moving the ID relative to the OD. Below are given example formulas which can be used in selecting ratios for round speakers.

Table 1 gives the formula for Phi, the value upon which the Fibonacci sequence and other natural phenomena are built.

TABLE 1

| Phi |
|---|
| $\text{Phi} = \sqrt{1 + \sqrt{1 + \sqrt{1 + \sqrt{\ldots}}}}$ |

Table 2 gives a simpler formula for approximating Phi, which may also be termed the golden ratio GR. Having an LS:SS ratio of approximately Phi or $\text{Phi}^2$ may, in many applications, produce good results. In some applications, having a ratio of the LS or the SS versus the intermediately sized portions of Phi or $\text{Phi}^2$ may be advantageous.

TABLE 2

| Golden Ratio aka Phi |
|---|
| $\text{GR} = 0.5 + \frac{\sqrt{5}}{2} = 1.618034$ |

Table 3 gives a formula for calculating the functional diameter FOD of the diaphragm, which is the overall diameter minus the distance which is occupied by the voice coil.

TABLE 3

| Functional OD |
|---|
| FOD = OD − ID |

Table 4 gives a formula for calculating the length of the projected chord LS on the longer side of the diaphragm, measured from the bobbin to the surround. Bdepth is the depth of the cone or diaphragm, or, in other words, the distance between the diaphragm's OD plane and the diaphragm's ID plane.

TABLE 4

| Length of Projected Long Chord |
|---|
| $\text{LS} = \frac{\lfloor \text{GR}^2 \cdot \text{FOD} - \sqrt{(-\text{Bdepth}^2 + 2 \cdot \text{GR}^2 \cdot \text{Bdepth}^2 + \text{GR}^2 \cdot \text{FOD}^2 - \text{GR}^4 \cdot \text{BDepth}^2)} \rfloor}{\text{GR}^2 - 1}$ |

Table 5 gives a formula for calculating the distance which the geometric center $A_{od}$ of the diaphragm is offset from the axis $A_m$ of the motor assembly.

TABLE 5

| Offset from $A_m$ to $A_{od}$ |
|---|
| $\text{Offset} = \text{LS} - \frac{\text{FOD}}{2}$ |

Table 6 gives a formula for calculating the length of the projected chord on the shorter side of the diaphragm, measured from the bobbin to the surround.

TABLE 6

| Length of Projected Short Chord |
|---|
| SS = FOD − LS |

Table 7 gives a formula for calculating the centeredness ratio of the speaker, which is the ratio of the lengths of the short and long projected chords.

TABLE 7

| Centeredness Ratio |
|---|
| $\text{CenterRatio} = \frac{\text{SS}}{\text{LS}}$ |

Table 8 gives the value of rho, the density of air.

TABLE 8

| Density of Air |
|---|
| $\rho = 1.18$ |

Table 9 gives a formula for calculating the air load mass on the diaphragm, ignoring the air load mass that will be on the dust cap, or, more precisely, the portion of the dust cap which overlies the bobbin.

TABLE 9

| Air Load Mass, Excluding Voice Coil Area |
|---|
| $M_{al} = \frac{\rho \cdot \text{FOD}^3}{3{,}000{,}000}$ |

In order to prevent rocking of the diaphragm, which may distort the sound or, if it becomes exaggerated enough, may even cause the bobbin to impact the pole piece or plate, it is desirable to balance the diaphragm. The diaphragm may be balanced, to a first order of approximation, by forming the diaphragm such that any two opposing chord cross-sections are of equal area; in other words, opposite strips of diaphragm will have equal mass.

Table 10 gives a formula for calculating how much the mass of the short chord side of the diaphragm should be adjusted upward, and the mass of the long chord side of the diaphragm should be adjusted downward from this equal mass configuration, in order to balance the diaphragm over the axis of the bobbin to a next order of approximation, which includes the air load mass difference.

TABLE 10

| Diaphragm Mass Adjustment |
|---|
| $\text{Delta} = \frac{M_{al} \cdot \text{CenterRatio}}{2 \cdot \text{ConeMass}}$ |

CONCLUSION

In order to achieve desired acoustic results, the dimensional ratio between the short side and the long side may be adjusted by moving the ID relative to the OD. In some applications, the speaker designer may elect to design a speaker in which the ratio is determined as between one of the long side and short side versus a midpoint side (e.g. 24M in FIG. 13).

In order to prevent rocking of the diaphragm, which may distort the sound or, if it becomes exaggerated enough, may even cause the bobbin to impact the pole piece or plate, it is desirable to balance the diaphragm. The diaphragm may be balanced, to a first order of approximation, by forming the diaphragm such that any two opposing chord cross-sections are of equal area; in other words, opposite strips of diaphragm will have equal mass.

Further improvements may be made by making further adjustments for the relative moments of rotational inertia of the respective chords, to further reduce the tendency of the diaphragm assembly to rock as it accelerates in and out of the motor assembly.

The invention may be practiced with diaphragms of any suitable shape, such as but not limited to circular, elliptical, oval, egg-shaped, rectangular, or any polygon. In some implementations, a conical diaphragm may be used. A conical diaphragm may be said to have an apex at its "deepest" point; this is typically where the bobbin is mounted.

Mass may be added to portions of the diaphragm, to balance it, either by adding actual diaphragm material, or by adding some other material or fixture. Suspension stiffness may be adjusted asymmetrically in order to compensate for mass imbalances or differences in rotational moments.

Reference in the specification to "an embodiment," "one embodiment," "some embodiments," or "other embodiments" means that a particular feature, structure, or characteristic described in connection with the embodiments is included in at least some embodiments, but not necessarily all embodiments, of the invention. The various appearances "an embodiment," "one embodiment," or "some embodiments" are not necessarily all referring to the same embodiments.

If the specification states a component, feature, structure, or characteristic "may", "might", or "could" be included, that particular component, feature, structure, or characteristic is not required to be included. If the specification or claim refers to "a" or "an" element, that does not mean there is only one of the element. If the specification or claims refer to "an additional" element, that does not preclude there being more than one of the additional element.

When one component is said to be "adjacent" another component, it should not be interpreted to mean that there is absolutely nothing between the two components, only that they are in the order indicated.

The several features illustrated in the various figures may be combined in many ways, and should not be interpreted as though limited to the specific embodiments in which they were explained and shown.

Those skilled in the art having the benefit of this disclosure will appreciate that many other variations from the foregoing description and drawings may be made within the scope of the present invention. Indeed, the invention is not limited to the details described above. Rather, it is the following claims including any amendments thereto that define the scope of the invention.

What is claimed is:

1. An audio speaker comprising:

a frame;

a motor structure coupled to the frame and having an axis $A_m$; and a diaphragm assembly including, a bobbin, a voice coil coupled to the bobbin, an asymmetric conical rigid diaphragm coupled to the bobbin and having a geometric center $A_{od}$ located at a position substantially removed from the axis of the motor structure, a surround coupled the diaphragm to the frame, and means for preventing rocking of the diaphragm during operation of the speaker;

wherein a centroid of the diaphragm assembly is located within the bobbin and removed from the Aod of the diaphragm.

2. The audio speaker of claim 1 wherein:

the diaphragm is substantially circular and the bobbin is located away from a center of the circular diaphragm.

3. The audio speaker of claim 1 wherein:

the diaphragm is substantially elliptical; and the bobbin is located away from at least one line of lateral symmetry of the elliptical diaphragm.

4. The audio speaker of claim 1 wherein:

the diaphragm has a non-uniform mass distribution.

5. The audio speaker of claim 4 wherein:

the mass of the diaphragm is biased toward a short side of the diaphragm.

6. The audio speaker of claim 5 wherein:

the diaphragm is differentially foamed.

7. An audio speaker comprising:

a frame;

a motor structure coupled to the frame and having an axis $A_m$; and a diaphragm assembly including, a bobbin, a voice coil coupled to the bobbin, an asymmetric conical rigid diaphragm coupled to the bobbin and having a geometric center $A_{od}$ located at a position substantially removed from the axis of the motor structure, a surround coupling the diaphragm to the frame, and means for preventing rocking of the diaphragm during operation of the speaker;

a spider coupled to the bobbin and to one of the frame and the motor structure; and means for moving an axis of suspension of one of the surround and the spider.

8. The audio speaker of claim 7 wherein the means for moving comprises:

an eccentric spacer coupled between the bobbin and the spider.

9. The audio speaker of claim 7 wherein the means for moving comprises:

at least one of the surround and the spider having an asymmetric construction.

10. The audio speaker of claim 9 wherein:

at least one of the surround and the spider is stiffer on a long side of the diaphragm than on a short side of the diaphragm.

11. The audio speaker of claim 7 wherein:

a centroid of the diaphragm assembly is disposed substantially at an average axis of the spider and the surround.

12. The audio speaker of claim 7 wherein:

the diaphragm has a non-uniform cross-sectional thickness.

13. The audio speaker of claim 12 wherein:

the diaphragm is thicker on a short side than on a long side.

14. An audio speaker diaphragm, comprising:

an asymmetric conical rigid acoustical radiating member having, an outer perimeter OD with a geometric center Aod, and an inner perimeter ID with a geometric center Aid; and means for reducing rocking of the acoustical radiating member by relocating at least one of a center of mass and a centroid of the acoustical radiating member;

wherein the means for rocking comprises the acoustical radiating member having more of its mass on a short side than on a long side of the acoustical radiating member, the long side including the Aod of the acoustical radiating member.

15. The audio speaker diaphragm of claim 14 wherein the means for reducing rocking further comprises:

an eccentric rigid spacer coupled to a bobbin which is coupled to the acoustical radiating member.

16. An audio speaker diaphragm comprising:

an asymmetric conical rigid acoustical radiating member having, an outer perimeter OD with a geometric center Aod, and an inner perimeter ID with a geometric center Aid; and means for reducing rocking of the acoustical radiating member by relocating at least one of a center of mass and a centroid of the acoustical radiating member;

wherein the means for reducing rocking comprises asymmetric suspension of the acoustical radiating member by at least one of a surround and a spider.

17. An audio speaker comprising:

a frame;

a motor structure coupled to the frame and including a magnetic air gap;

a bobbin;

a voice coil coupled to the bobbin and disposed within the magnetic air gap;

an asymmetric rigid conical diaphragm coupled to the bobbin;

a surround coupled to the diaphragm and to the frame; and a spider coupled to the bobbin and to the frame;

wherein at least one of the surround and the spider is asymmetric.

* * * * *